US006345560B1

(12) United States Patent
Strauch et al.

(10) Patent No.: US 6,345,560 B1
(45) Date of Patent: Feb. 12, 2002

(54) CLAMPING CHUCK FOR BITS

(75) Inventors: Martin Strauch; Sylvester Rosanwo; André Müller, all of Wuppertal; Werner Tretbar, Radevormwald, all of (DE)

(73) Assignee: Wera-Werk Hermann Werner GmbH & Co., Wuppertal (DE)

( * ) Notice: Subject to any disclaimer, the term of this patent is extended or adjusted under 35 U.S.C. 154(b) by 0 days.

(21) Appl. No.: 09/424,818

(22) PCT Filed: May 23, 1998

(86) PCT No.: PCT/EP98/03058

§ 371 Date: Nov. 29, 1999

§ 102(e) Date: Nov. 29, 1999

(87) PCT Pub. No.: WO98/55268

PCT Pub. Date: Dec. 10, 1998

(30) Foreign Application Priority Data

Jun. 2, 1997 (DE) ..... 197 22 776
Feb. 3, 1998 (DE) ..... 198 04 081

(51) Int. Cl.[7] ..... B25B 23/159
(52) U.S. Cl. ..... 81/477
(58) Field of Search ..... 81/467, 477; 173/180

(56) References Cited

U.S. PATENT DOCUMENTS 2,409,385 A * 10/1946 Pletcher ..... 81/477
3,129,571 A * 4/1964 Reynolds ..... 81/477
3,744,350 A 7/1973 Raff
3,832,916 A * 9/1974 Schoeps ..... 81/477
4,572,041 A * 2/1986 Rissmann ..... 81/477
4,774,864 A * 10/1988 Dossier ..... 81/477

FOREIGN PATENT DOCUMENTS

DE 9000245 5/1991
DE 4143218 9/1992

* cited by examiner

*Primary Examiner*—Joseph J. Hail, III
*Assistant Examiner*—Joni B. Danganan
(74) *Attorney, Agent, or Firm*—Martin A. Farber

(57) ABSTRACT

A clamping chuck comprising a shank which has two sleeve-like shank sections (5, 6), one of the sleeve-like sections (6) on an end side thereof being coordinated to a clamping section (1) for clamping into a drive member, and the other of the sleeve-like sections (5) on its end side being coordinated to a toolholder (2) for mounting a tool, in particular a screwdriver bit (18). The two sleeve-like shank sections (5, 6), by a torsion section (3) formed by a torsion member (7) coordinated to cavities of the shank sections, being twistable with respect to one another about a stop-limited angular distance (a-b), wherein the torsion section (3) is arranged between two hexagon sections of the torsion member (7), by which hexagon sections the torsion member is fitted without play into hexagon profile sections in the cavities (10, 11) of the sleeve-like shank sections (5, 6), and the torsion member continues, as one material integral piece into the clamping section formed as an insertion section (1).

19 Claims, 5 Drawing Sheets

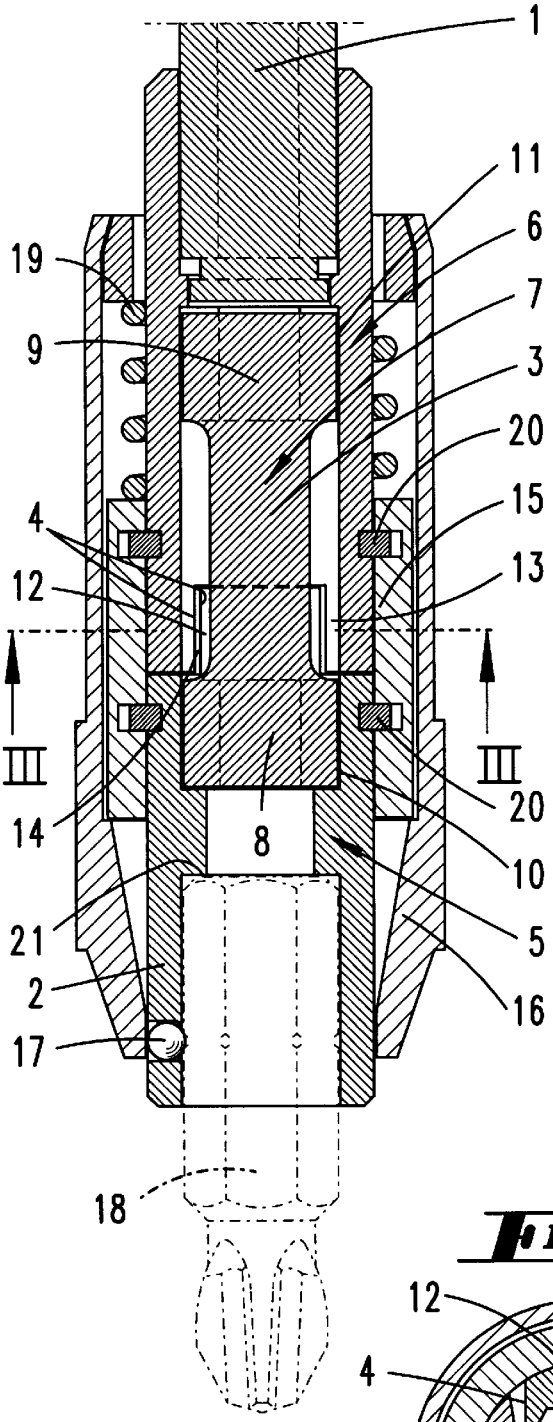
Fig. 2
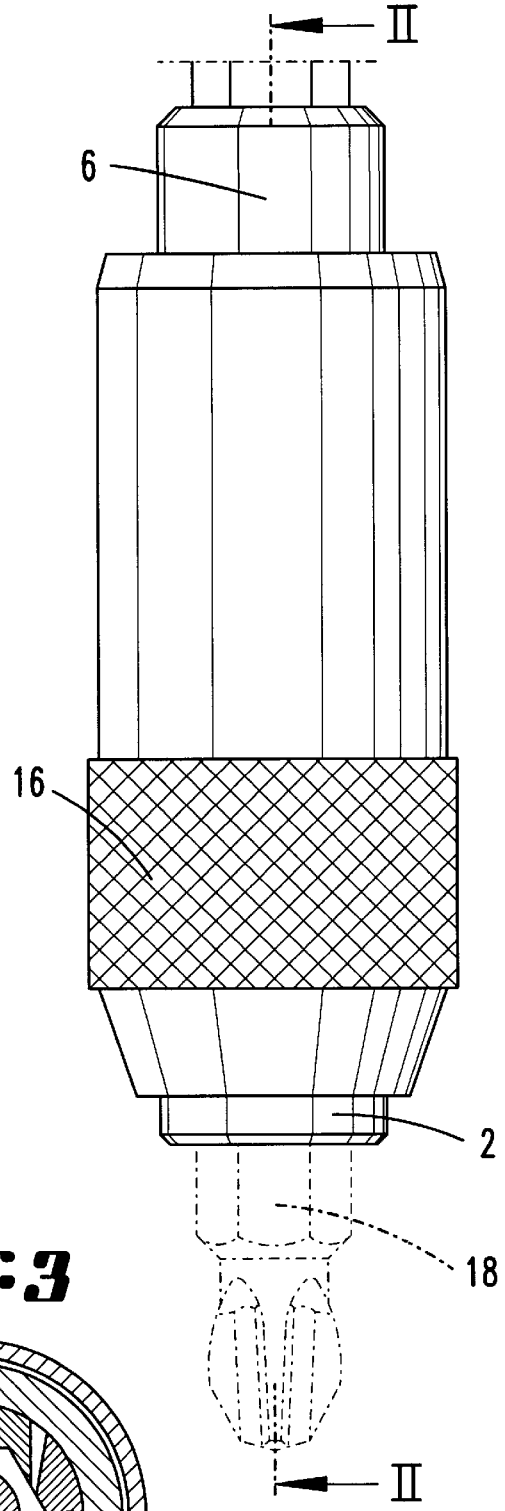
Fig. 1
Fig. 3
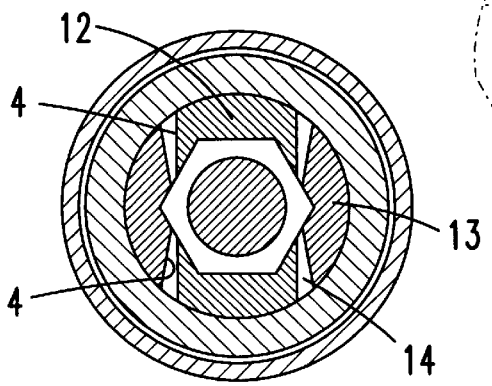

CLAMPING CHUCK FOR BITS

FIELD AND BACKGROUND OF THE INVENTION

The invention relates to a clamping according to the pre-characterizing clause of claim 1.

A clamping chuck of this type is known from German utility model 90 00 245.8. The known clamping chuck possesses a clamping portion, by means of which the clamping chuck can be clamped into an electric screwdriver or the like. The shank forming this clamping portion at one end possesses, at the other end, a toolholder for accommodating a screwdriver insert or the like. In the prior art, it is known, furthermore, to provide screwdriver inserts with a torsional portion, in order to absorb torsion peaks when a screw is being screwed in. The maximum torque in the peaks is thereby to be absorbed. The torque peaks are reduced and smoothed.

SUMMARY OF THE INVENTION

The object on which the invention is based is, therefore, to improve a clamping chuck of this type in functional terms.

According to the invention, the torsional portion is associated with the clamping chuck. What is ensured at the same time is that elastic twistability takes place only over a predetermined angular range, so as to prevent damage to the torsion member. The torsion member preferably couples two shank portions located axially one behind the other. These shank portions can be rotated relative to one another until a limiting torque is reached. Stops are provided, which are spaced from one another by a gap. The shank portions consist preferably of sleeve portions located one behind the other. The two ends of the preferably dumbbell-shaped torsion member fit positively in the cavities of these sleeve portions. In a first variant of the invention, the stops may be formed by the two sleeve-shaped shank portions. Preferably, these stops are formed by sleeve edge portions of the shank portions, the said sleeve edge portions engaging with movement play one in the other. The torsion portion of the torsion member is preferably cylindrical. Furthermore, a cuff may be provided, which spans the connecting joint between the two shank portions. The cuff ensures that the two shank portions are restrained in the axial direction, but allows rotatability of the two shank portions relative to one another, the angular amount of rotatability being determined by the gap width between the two stops. In a further variant of the invention, the two sleeve portions may likewise be rotated relative to one another until the limiting torque is reached. There, however, the stops are formed by a profile portion which directly adjoins the torsion zone and which engages undersized into a corresponding profiling of the sleeve surrounding the torsion portion, so that, as in the first exemplary embodiment, this sleeve is loaded with a torque only when the limiting torque is reached and the two profile portions have rotated relative to one another by a corresponding angular amount. In a preferred embodiment, the torsion portion is a materially integral prolongation of the clamping portion. The torsion portion may be prolonged in a materially integral manner into a securing portion, by means of which the core forming the clamping portion is connected fixedly in terms of rotation to a shank portion forming the toolholder. The two sleeve-like shank portions may butt one against the other so as to form a circumferential joint. This joint may have oblique end faces. The clamping chuck may be provided, furthermore, with an actuating sleeve which spans the cuff. As regards the functioning of the actuating sleeve and of the clamping means which is formed as a ball, reference is made to German utility model specification 90 00 245.3. The two sleeves are held by means of the torsion member in an angular position relative to one another such that elastic yieldability is possible both in the left-hand direction and in the right-hand direction. There is movement play on both sides. During the movement of the two sleeves relative to one another, the torsion member is twisted. Up to a first limiting torque, the clamping chuck behaves in the same way as a virtually rigid body. The first limiting torque is defined by the dimensioning and pre-treatment of the torsion portion of the torsion member. When the first limiting torque is exceeded, the torsion member gives way in a resiliently elastic manner, the torsion portion twisting until the two stops butt one against the other. Between the two limiting torques, the two shank, portions can be rotated relative to one another by the amount of the movement play. As soon as the stops butt one against the other, the clamping chuck acts once again as a virtually rigid body.

BRIEF DESCRIPTION OF THE DRAWINGS

Exemplary embodiments of the invention are explained below with reference to accompanying figures of the drawing in which FIG. 1 shows a view of a clamping chuck according to the invention of a first exemplary embodiment, FIG. 2 shows a section along the line II—II in FIG. 1, FIG. 3 shows a section along the line III—III in FIG. 2.

DETAILED DESCRIPTION OF THE PREFERRED EMBODIMENTS

Figure 4:
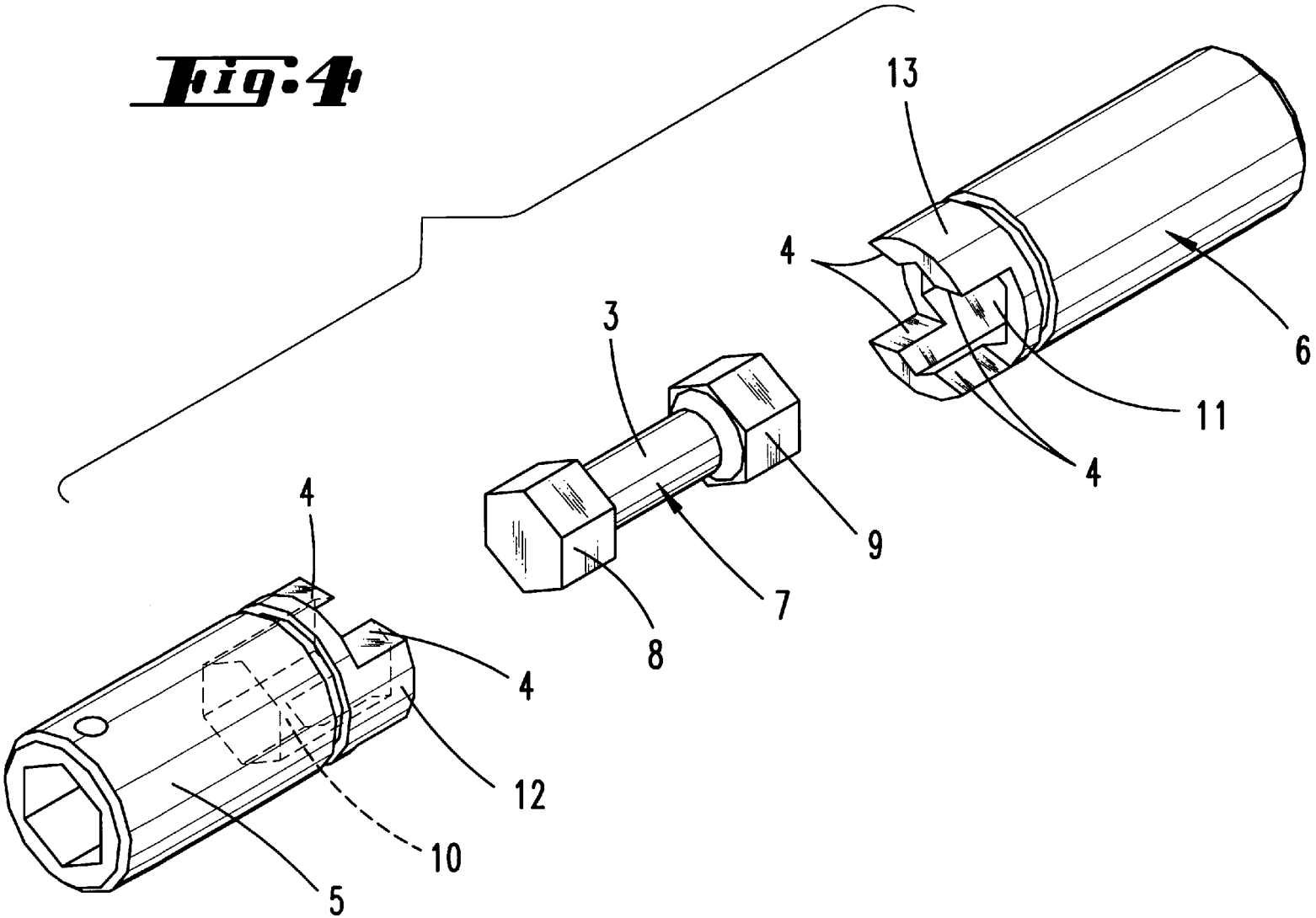
FIG. 4 shows an exploded illustration of the two shank portions and of the torsion member.

The clamping chuck of the first exemplary embodiment possesses a polygonal, in particular hexagonal clamping portion 1, by means of which the clamping chuck can be clamped into a drive member, for example a drilling machine. The end of the clamping portion is seated positively in one end of a sleeve-shaped shank portion 6 so as to be secured both in the direction of rotation and in the axial direction.

The other end of the sleeve-shaped shank portion 6 possesses a cavity 11 which has a polygonal, in particular hexagonal profile. Adjoining the latter, there is provided a second shank portion 5 which likewise has a similarly profiled cavity 10 which is located opposite the cavity 11. The shank portion 5 possesses a toolholder 2 which likewise has a polygonal profile, in particular a hexagonal profile, for the insertion of a bit 18. The bit 18 possesses, on its polygonal portion, corner recesses, into which a ball 17 presses, in order to hold the bit 18 in a restrained position in the clamping chuck.

The ball 17 can be shifted into a releasing location by the displacement of an actuating sleeve 16. The actuating sleeve 16 is actuated by the sleeve being shifted axially counter to the pressure of a spring 19.

The actuating sleeve 16 spans a cuff 15 which spans the separating joint of the two shank portions 5, 6. In the region of the separating joint of the shank portions 5, 6, the ends of the shank portions 5, 6 are provided with extensions 12, 13 which engage one in the other in a claw-like manner, with formation of a gap 14, so that relative rotation of the two shank portions 5, 6 by about 10° in both directions is possible.

A dumbbell-shaped torsion member 7 is inserted into the cavities 10, 11 of the two shank portions 5, 6. In the middle region, the torsion member 7 possesses a cylindrical torsion portion 3 which can rotate under the action of torque. The ends 8, 9 of the torsion member 7 are provided with a hexagonal profile which engages, substantially free of play, into the cavities 10, 11, so that the torsion member 7 acts as a rotational take-up member between the two shank portions 5, 6.

Since the cuff 15 is connected to the two shank portions 5, 6 via holding rings 20, the two shank portions are restrained axially relative to one another, but can rotate relative to one another by the angular amount defined by the gap width.

Figure 5:
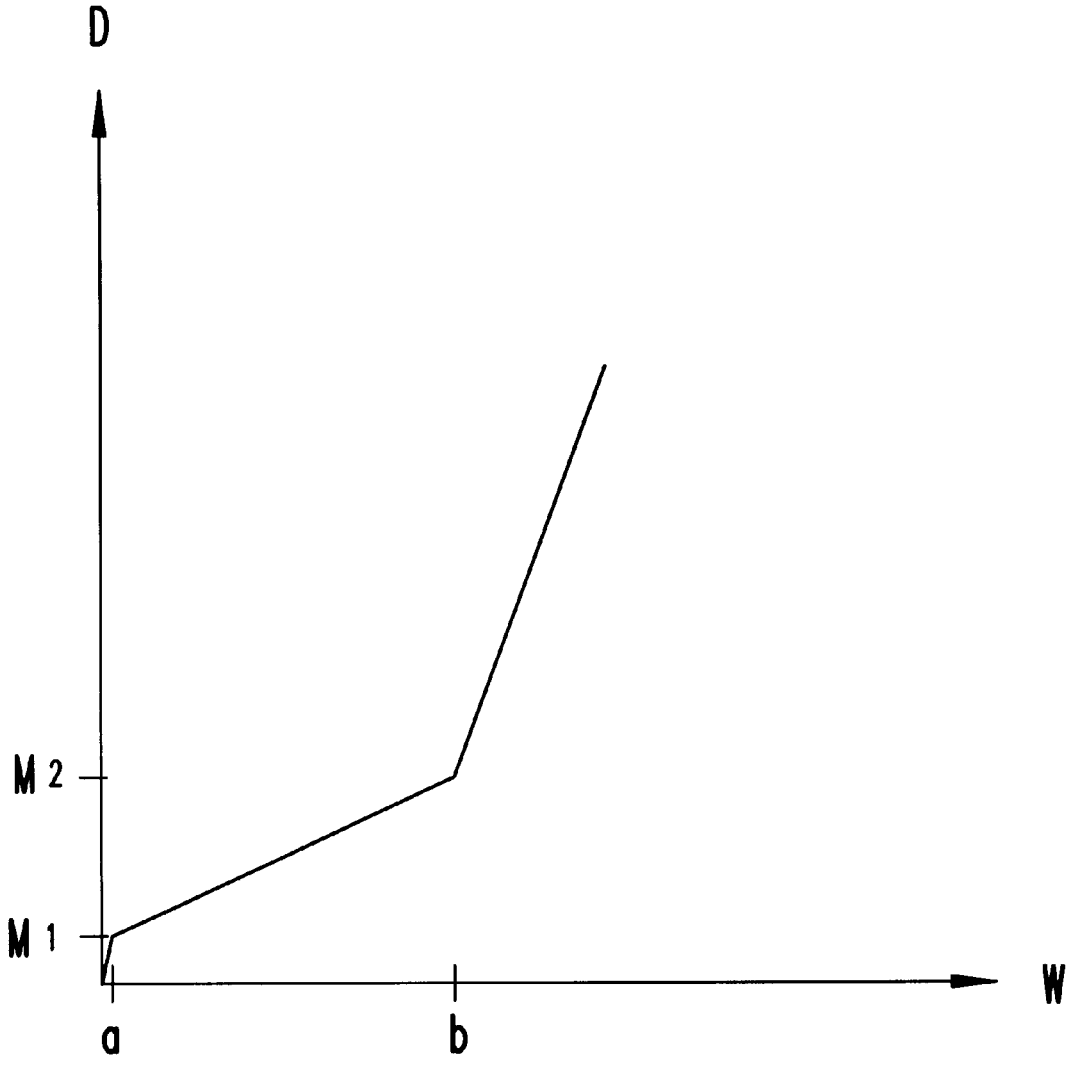
FIG. 5 shows a diagrammatic illustration of the torque/torsion characteristic.
Figure 7:
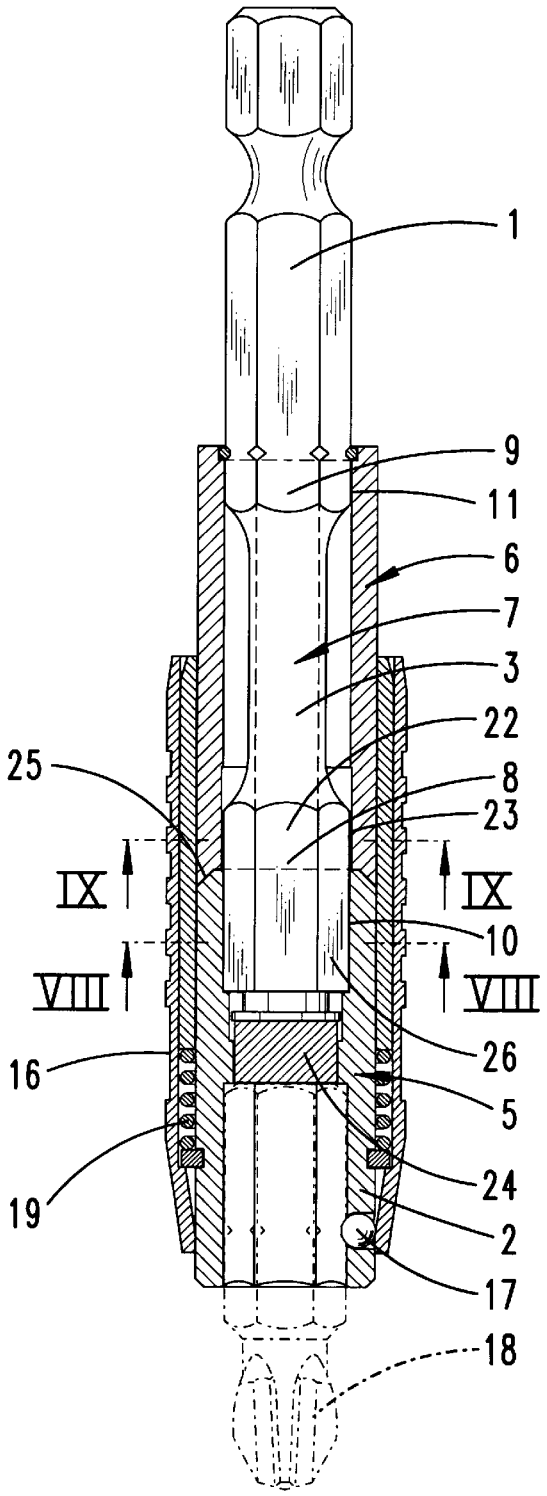
FIG. 7 shows a section along the line VII—VII in FIG. 6.
Figure 6:
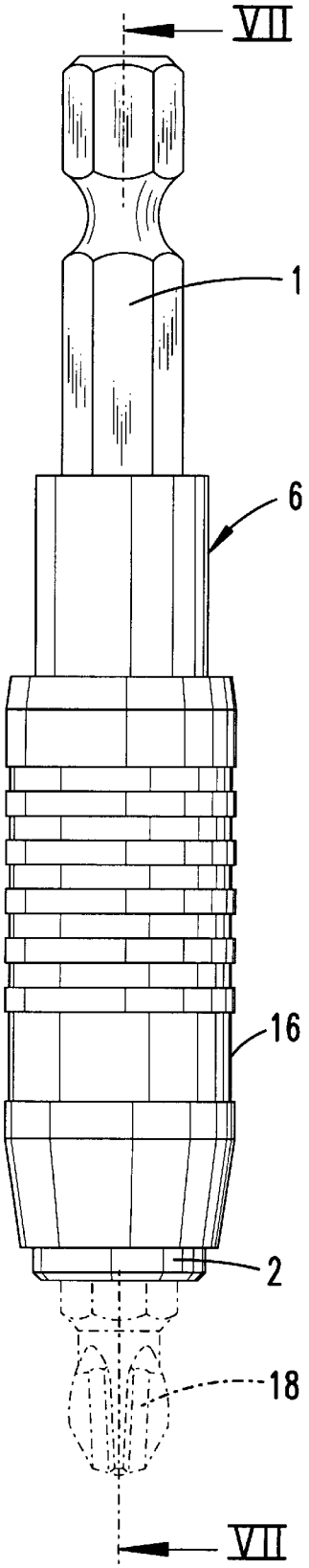
FIG. 6 shows an illustration of a second exemplary embodiment according to FIG. 1.
Figure 8:
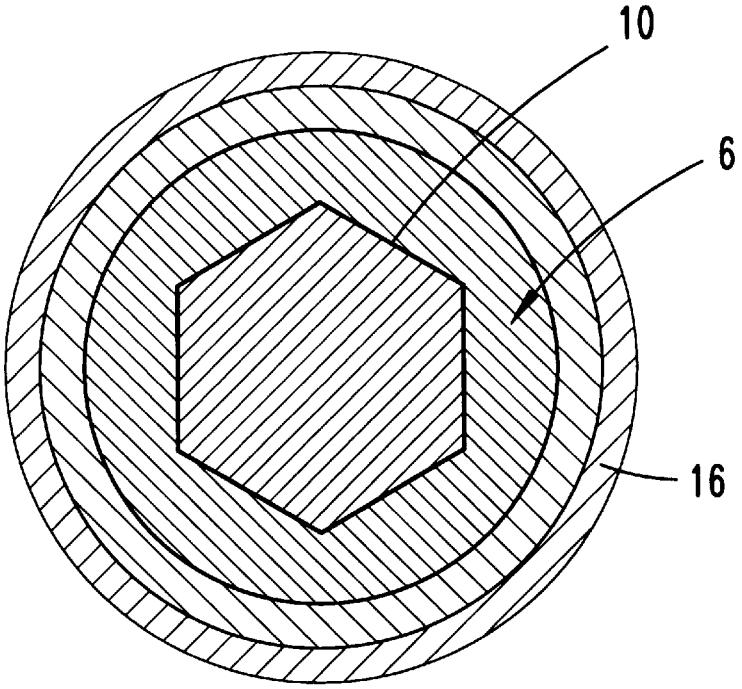
FIG. 8 shows a section along the line VIII—VIII in FIG. 7.

So that the two shank portions 5, 6 can be rotated relative to one another, some torque has to be applied, which may exceed a first torque M1. This first torque M1 is determined by the hardness profile or pre-treatment of the bit. Up to then, the clamping chuck twists only slightly by the angle a. When the torque increases, the two shank portions 5, 6 rotate through the angle W, until the second limiting torque M2 is reached in an angular position b. The two stops 4, which are formed by the extensions 12, 13, then butt one against the other, so that an immediate torque take-up of the two shank portions 5, 6 is effected. As is apparent from FIG. 5, the clamping chuck then behaves like a virtually rigid body, in a similar way to the low-torque range. Only in the range between the two limiting torques M1 and M2 can the two shank portions 5, 6 be rotated relative to one another as a result of the elastic deformation of the torsion portion 3.

It is pertinent that the clamping chuck acts more rigidly above the second limiting torque than below the second limiting torque, where it can yield to torsion in a resiliently elastic manner.

The resilient behaviour between the angles a and b below the second limiting torque is determined substantially by the geometry and material of the torsion portion 3. It is possible to produce clamping chucks with different torsion properties by providing the various clamping chucks with different torsion members.

The toolholder 2 possesses a cavity which, on the bottom side, forms a shoulder 21, against which an edge portion of the end face of the bit 18 can engage. This shoulder is formed by a narrowing-in of the cavity 10 of the shank portion 5.

In an embodiment which is not illustrated, there is provision for providing, between the clamping portion 1 and the end 9 of the torsion member 7, a magnet which, for example, is adhesively bonded, soldered or otherwise secured to the torsion member 7. For the optimum transmission of magnetic force to the bit 18, the end face of the bit can engage over its surface on the other end 8 of the torsion member 7.

The torsion portion 3 is located in the region of the separating joint of the two shank portions 5, 6. In this region too, the cavity possesses a hexagonal profile. The diameter of the torsion portion 3 of circular cross section is smaller than the clear distance between the hexagonal faces, so that free twisting is possible.

The second exemplary embodiment likewise possesses an insertion portion 1, but this is continued in a materially integral manner into the torsion portion 3 and, further on, in a profile portion 26, by means of which the core thus formed fits fixedly in terms of rotation in a cavity 10 of the shank portion 5 forming the toolholder 2. The shank portion 5 is formed by a sleeve which likewise carries a magnet 24 forming the bottom of the toolholder 2. The locking of the tool 18 via ball 17 and actuating sleeves 16 takes place in the same way as in the first exemplary embodiment. The actuating sleeve 16 does not possess any fluting on the outside, but, instead, peripheral grooves.

Figure 9:
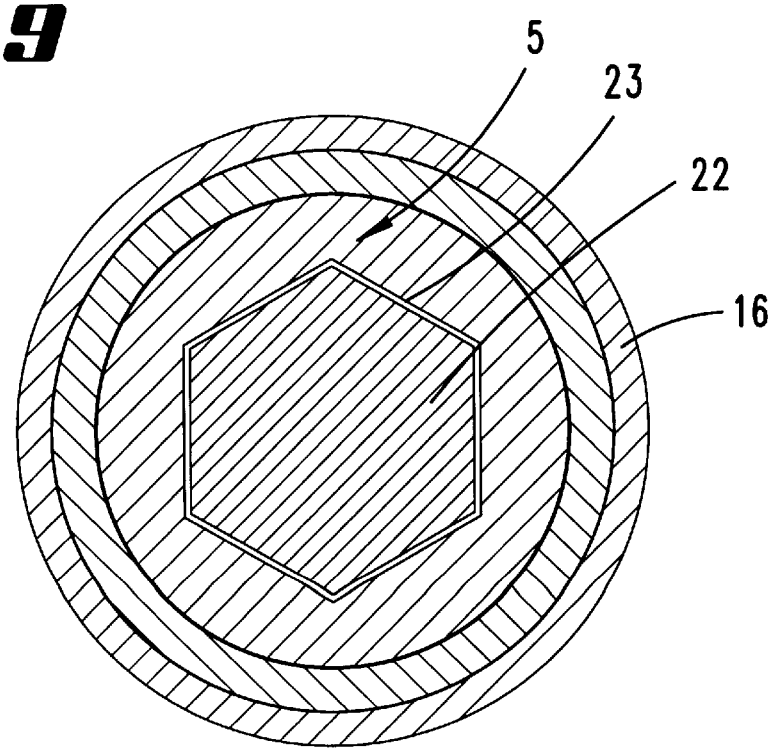
FIG. 9 shows a section along the line IX—IX in FIG. 7.

As stated, the sleeve-shaped shank portion 5 is connected fixedly in terms of rotation to a materially integral prolongation of the insertion portion 1. A further sleeve-shaped shank portion 6 is located in an axial position between insertion portion 1 and shank portion 5. This shank portion 6 possesses a profiled cavity 11 which is directly adjacent to the insertion portion 1. Seated with slight play in this profiled cavity 11 is one end 9 of the torsion member 7, the said end having a profile corresponding to that of the insertion portion 1. As in the first exemplary embodiment, the torsion member 7 possesses a torsion portion 3 in the form of a narrowing. On the far side of the narrowing 3, the torsion portion 7 possesses a profiled portion 22 which fits undersized, and with greater play, in a corresponding hollow profiling 23 of the sleeve-shaped portion 6. FIG. 9 illustrates how the hexagonal profile 22 fits in a likewise hexagonal clearance 23 of the portion 6, the said clearance being formed oversized. The two profiles 22, 23 come into torque-transmitting bearing contact when they have previously been rotated relative to one another by a particular angular amount.

The identically profiled prolongation 26 of the profile portion 22 is coupled fixedly in terms of rotation to the portion 5. The two shank portions 5, 6 butt one against the other in the form of a peripheral joint 25 provided with oblique end edges, so that the two portions 5, 6 can rotate relative to one another.

In the second exemplary embodiment, it is considered advantageous that only one core part is provided, which, at one end, forms a clamping portion 1 and at its other end is connected fixedly in terms of rotation to the toolholder 2. This core is provided in such a way that it forms a torsion portion 3, for example by means of a cross-sectionally narrowed zone. The torsion portion 3 is delimited by identically formed hexagonal profiles, so that the core can be produced from extruded hexagonal material. The profile portion 9 adjacent to the torsion zone 3 on the clamping-portion side is inserted in a corresponding profile cavity 11 of a sleeve 6 with less play than that with which the profile portion 22 located on the far side of the torsion zone 3 lies in a profile cavity 23. The sleeve-shaped portion 6 therefore serves as a torque-transmitting member only when a limiting torque is exceeded.

We claim:

1. A clamping chuck with a shank which forms two shank portions (5, 6) and which at one end forms a clamping portion (1) for clamping into a drive member and at the other end forms a toolholder (2) for accommodating a tool, in particular a screwdriver bit (18), an elastic element between the clamping-side shank portion (6) and the toolholder-side shank portion (5) for transmission of torque until a limiting torque (M2) is achieved in a stop-limited manner, up to reaching of said torque the clamping portion (1) and the tool holder (2) rotate relative to one another, the elastic element being inserted in a sleeve comprising the shank portion (6)

for torque transmission in event of a torque exceeding the limiting torque (M2), wherein the elastic element is formed by a cylindrical torsion portion in form of a narrowing located between two portions (8, 9, 22) thereof of polygonal shape, the torsion portion forming a torsion member (7) together with the portions (8, 9, 22) of polygonal shape which portions are inserted into correspondingly shaped cavities (10, 11, 23) in the shank portions, the torque transmission between the portions (8, 9, 22) of polygonal shape, which rotate relative to one another through an angular extent (b) until the limiting torque (M2) is reached, and the shaped cavities (10, 11, 23) being effected by positive locking by shape of the portions (8, 9, 22) and the correspondingly shaped cavities (10, 11, 23).

2. The clamping chuck according to claim 1, wherein the two shank portions (5, 6) form sleeve portions which are located axially one behind the other and in the cavities (10, 11) of which ends (8, 9) comprising the two portions of the torsion member (7) are accommodated in a positively-locking manner.

3. The clamping chuck according to claim 2, wherein the two sleeve-shaped shank portions (5, 6) butt one against the other so as to form an oblique peripheral separating joint (25).

4. The clamping chuck according to claim 1, further comprising stops formed by sleeve edge portions (12, 13) of the shank portions (5, 6), the sleeve edge portions engaging one in the other with movement play.

5. The clamping chuck according to claim 1, further comprising a cuff (15), wherein the two shank portions (5, 6) located axially one behind the other are surrounded by said cuff (15) in a region of their separating joint.

6. The clamping chuck according to claim 5, further comprising an axially displaceable actuating sleeve (16), spanning the cuff (15), for releasable retention of a clamping means (17) for toolholding.

7. The clamping chuck according to claim 1, further comprising stops formed by a profile portion (22) of the torsion member (7), said profile portion fitting with movement play in a hollow cavity (23) of the clamping-side shank portion which is formed as sleeve (6).

8. The clamping chuck according to claim 1, wherein the torsion portion (7) is a materially integral prolongation of the clamping portion (1).

9. The clamping chuck according to claim 1, wherein a materially integral prolongation (26) of the torsion portion is in rotationally fixed rotational take-up with the shank portion (5) forming the toolholder (2).

10. The clamping chuck according to claim 1, wherein a profile portion (22) of the torsion member is fitted with movement play in a profiled hollow profile (23) of the shank portion (6) and has a same hexagonal profile as a profile portion (26) of the torsion member, and said profile portion (26) is in fixed rotational take-up with the shank portion (5).

11. The clamping chuck according to claim 10, wherein a core forming the clamping portion (1), the torsion portion (3) and the profile portion (26) are manufactured from an extruded hexagonal-shaped part.

12. The clamping chuck according to claim 1, wherein the sleeve (6) which is torsionally loaded only when the limiting torque and torsion of the torsion portion (3) are exceeded and which forms the clamping-side shank portion forms on an end face a hexagonal inner profile or the like and, with play at least on one side, spans profiled ends (8, 9) of the torsion member.

13. The clamping chuck according to claim 12, wherein the portion (22) of polygonal shape which fits undersized in the shaped cavity (23) continues with identical shape into portion (10) of polygonal shape, on which there is seated a sleeve portion (5) forming the toolholder (2).

14. A clamping chuck comprising a shank which has two sleeve-like shank sections (5, 6), one of the sleeve-like shank sections (6) on an end side thereof being coordinated to a clamping section (1) for clamping into a drive member, and the other of said sleeve-like shank sections (5) on its end side being coordinated to a toolholder (2) for mounting a tool, in particular a screwdriver bit (18), and the two sleeve-like shank sections (5, 6), by a torsion section (3) formed by a torsion member (7) coordinated to cavities of said shank sections, being twistable with respect to one another about a stop-limited angular distance (a-b), wherein the torsion section (3) is arranged between two hexagon sections of the torsion member (7), by which hexagon sections the torsion member is fitted without play into hexagon profile sections in the cavities (10, 11) of the sleeve-like shank sections (5, 6), and the torsion member continues, as one materially integral piece, into the clamping section formed as an insertion section (1).

15. A clamping chuck comprising a shank which has two sleeve-like shank sections (5, 6), one of the sleeve-like shank sections (6) on an end side thereof being coordinated to a clamping section (1) for clamping into a drive member, and the other of said sleeve-like shank sections (5) on its end side being coordinated to a toolholder (2) for mounting a tool, in particular a screwdriver bit (18), and the two sleeve-like shank sections (5, 6), by a torsion section (3) formed by a torsion member (7) coordinated to cavities of said shank sections, being twistable with respect to one another about stop-limited angular distance (a-b) limited by a stop coordinated to a region of a separating joint between the two sleeve-like shank sections (5, 6), wherein the torsion section (3) is arranged between two hexagon sections of the torsion member (7), by which hexagon sections the torsion member is fitted without play into hexagon profile sections in the cavities (10, 11) of the sleeve-like shank sections (5, 6), and a cuff (15) spanning over said stop, axially restrains the shank-sections (5, 6).

16. The clamping chuck according to claim 15, wherein said stop comprises facing surfaces of extensions of the sleeve-like shank sections, in said separating joint of the sleeve-like shank sections.

17. The clamping chuck according to claim 16, wherein said cuff is a sleeve connected to the sleeve-like shank sections so as to restain axial movement of the sleeve-like shank sections relative to each other but permitting rotational movement relative to each other.

18. The clamping chuck according to claim 17, wherein said cuff is connected to the sleeve-like shank sections by rings.

19. The clamping chuck according to claim 16, wherein said extensions of the sleeve-like shank sections interengage in said separating joint in claw-like manner with formation of a gap (14).

* * * * *